US011207587B2

(12) United States Patent
Yamada

(10) Patent No.: US 11,207,587 B2
(45) Date of Patent: Dec. 28, 2021

(54) TRUCK STRUCTURE FOR SKATEBOARD

(71) Applicant: SURPATH TRADING CO., LTD., Chigasaki (JP)

(72) Inventor: Tsutomu Yamada, Chigasaki (JP)

(73) Assignee: SURPATH TRADING CO., LTD., Chigasaki (JP)

( * ) Notice: Subject to any disclaimer, the term of this patent is extended or adjusted under 35 U.S.C. 154(b) by 0 days.

(21) Appl. No.: 17/267,618

(22) PCT Filed: Jul. 20, 2020

(86) PCT No.: PCT/JP2020/027989
§ 371 (c)(1),
(2) Date: Feb. 10, 2021

(87) PCT Pub. No.: WO2021/137273
PCT Pub. Date: Jul. 8, 2021

(65) Prior Publication Data

US 2021/0308554 A1 Oct. 7, 2021

(30) Foreign Application Priority Data

Dec. 31, 2019 (JP) ..... JP2019-240108

(51) Int. Cl.
*A63C 17/00* (2006.01)
*A63C 17/01* (2006.01)

(52) U.S. Cl.
CPC ..... *A63C 17/012* (2013.01)

(58) Field of Classification Search
CPC ..... A63C 17/012; A63C 17/015; A63C 17/01; A63C 17/0093
(Continued)

(56) References Cited

U.S. PATENT DOCUMENTS 6,793,224 B2 * 9/2004 Stratton ..... A63C 17/01 280/87.041
6,979,009 B2 * 12/2005 Ichida ..... B62M 9/132 280/238
(Continued)

FOREIGN PATENT DOCUMENTS

JP S56-1685 U 1/1981
JP 2004-81757 A 3/2004
(Continued)

*Primary Examiner* — Hau V Phan
(74) *Attorney, Agent, or Firm* — Muncy, Geissler, Olds & Lowe, P.C.

(57) ABSTRACT

An upper through hole is formed in a support base, a lower end of the upper through hole being opened in an upper-side sliding contact surface of the support base, the upper through hole being configured to receive insertion of an upper portion of a pivot shaft; a lower through hole is formed in a rockable section, the lower through hole and the upper through hole being provided on the same axis, an upper end of the lower through hole being opened in contact with the upper-side sliding contact surface, the lower through hole being configured to receive insertion of a lower portion of the pivot shaft; an enlarged diameter hole section is provided in the lower through hole, the enlarged diameter hole section being configured to accommodate a needle bearing having a cylindrical shape, the needle bearing being fit to an outer side of at least a lower shaft portion of the pivot shaft; and the needle bearing having the cylindrical shape bears the lower shaft portion of the pivot shaft.

6 Claims, 5 Drawing Sheets

(58) Field of Classification Search
USPC ..... 280/11.27
See application file for complete search history.

(56) References Cited

U.S. PATENT DOCUMENTS

| | | | | |
|---|---|---|---|---|
| 7,104,558 | B1 * | 9/2006 | Saldana | A63C 17/0093 280/11.27 |
| 8,328,206 | B2 * | 12/2012 | Williams, Jr. | A63C 17/015 280/11.28 |
| 8,998,225 | B2 * | 4/2015 | Magee | A63C 17/0093 280/87.042 |
| 9,295,902 | B2 * | 3/2016 | Lininger, Jr. | A63C 17/0093 |
| 9,901,807 | B2 * | 2/2018 | Su | A63C 17/012 |
| 2002/0125670 | A1 | 9/2002 | Stratton | |
| 2013/0069331 | A1 * | 3/2013 | Yamada | A63C 17/0093 280/87.042 |
| 2013/0308887 | A1 * | 11/2013 | Gesmer | B60B 27/0005 384/523 |
| 2013/0314851 | A1 * | 11/2013 | Zietz | G01D 13/04 361/679.01 |
| 2015/0224386 | A1 * | 8/2015 | Baldauf | A63C 17/012 280/124.103 |

FOREIGN PATENT DOCUMENTS

| | | | |
|---|---|---|---|
| JP | 2018-517530 | A | 7/2018 |
| WO | 2011/128944 | A1 | 10/2011 |
| WO | 2016/203076 | A1 | 12/2016 |

* cited by examiner

TRUCK STRUCTURE FOR SKATEBOARD

TECHNICAL FIELD

This invention relates to a truck structure for a skateboard, the structure allowing for a smooth steering angle operation based on body weight shifting by bearing a lengthwise direction of a pivot shaft by means of a cylindrical needle bearing.

BACKGROUND ART

In the past, in the truck structure for a skateboard in Japanese Patent Application Laid-Open No. 2004-81757, the applicant of the present application has proposed a truck structure of a skateboard provided with a support for turnably supporting a truck leftward and rightward from a neutral position and returnably urging the truck to the neutral position, wherein the support comprises a weighting table fixed to a deck and a support table which is pivotally connected to this weighting table and turnable leftward and rightward and detachably and attachably fixes the truck, wherein a link piece is pivotally connected between the weighting table and the support table and, when said support table turns leftward and rightward from the neutral position, the support table is returned to the neutral position by a repulsive force of an elastic member compressed by the link piece.

With this structure, a pivot shaft which passes through the weighing table and the support table and allows the support table to rotate about an axis of the pivot shaft inside a through hole, but there is a problem in that unwanted friction occurs when a force acts on the pivot shaft in a direction other than the axial direction.

WO-A1-2011/128944 proposes a track structure which can, in a steering operation for automatically returning wheels to the neutral position by body weight shifting, return the wheels to the neutral position using elastic blocks. However, since a collar that supports the pivot shaft is supported by an elastic block, it is difficult to support the pivot shaft with stability.

In the truck for a skateboard of US Patent Application Publication No. 2002/125670 (U.S. Pat. No. 679,324), a collar is inserted in through holes of a fixed underframe and a pivotable frame and a threaded rod is inserted through the collar to form a pivot shaft, and on the pivoting surface thereof, a planar bearing such as a thrust needle bearing is provided so as to enable smooth rotation.

Similarly, in the publication of WO 2016/203076 (Japanese Patent No. 6444542), for carrying out rotation with a bolt serving as a rotation axis, a bearing system composed of two washers and a thrust needle bearing and a second axis needle bearing system composed two washers, different from the aforementioned, and a thrust needle bearing are used to enable smooth rotation about the rotation axis of the bolt.

With these structures, although stability can be achieved for rotating the rotation shaft in the thrust direction, it is still difficult to achieve adequate stability for supporting a load acting in a radial direction.

CITATION LIST

Patent Literature

Patent Literature 1: Japanese Patent Application Laid-Open No. 2004-81757

Patent Literature 2: WO-A1-2011/128944
Patent Literature 3: US Patent Application Publication No. 2002/125670
Patent Literature 4: WO 2016/203076

SUMMARY OF INVENTION

Technical Problem

A problem to be solved by this invention is to provide a truck structure for a skateboard such that, while a pivot shaft which passes through a base and a support disk and allows the support disk to pivot receives a load from different directions due to body movements of a user, since the truck structure is equipped with a needle bearing provided along the axial direction of the pivot shaft, even when a load is received in a perpendicular direction to a rotational axis, the pivot shaft can rotate in a radial direction smoothly and stably.

Solution to Problem

In order to solve the aforementioned problem, this invention provides, a truck structure for a skateboard includes a support base to be fixed to a deck; a rockable section to be pivotally attached to the support base by means of a pivot shaft, the rockable section including a truck section, the truck structure being configured to support the rockable section in a manner in which the rockable section is turnable in a left-right direction from a neutral position of the truck section; and a coil spring configured to bias the rockable section in a manner in which the rockable section is returnable to the neutral position, wherein an upper through hole is formed in the support base, a lower end of the upper through hole being opened in an upper-side sliding contact surface of the support base, the upper through hole being configured to receive insertion of an upper portion of the pivot shaft, a lower through hole is formed in the rockable section, the lower through hole and the upper through hole being provided on the same axis, an upper end of the lower through hole being opened in contact with the upper-side sliding contact surface, the lower through hole being configured to receive insertion of a lower portion of the pivot shaft, an enlarged diameter hole section is provided in the lower through hole, the enlarged diameter hole section being configured to accommodate a needle bearing having a cylindrical shape, the needle bearing being fit to an outer side of at least a lower shaft portion of the pivot shaft, the needle bearing has the cylindrical shape bears the lower shaft portion of the pivot shaft, the pivot shaft includes a collar and a fixing bolt to be inserted in the collar, the collar being configured to be inserted through the upper through hole and the lower through hole aligned on the same axis, the lower portion of the collar is formed in a tapered shape in which the diameter of the collar gradually decreases toward a lower side, and the needle bearing having the cylindrical shape and accommodated in the enlarged diameter hole section of the lower through hole is formed in a tapered shape that fits onto an outer side of at least the lower shaft portion of the pivot shaft.

In another invention disclosed in the application, the pivot shaft includes a collar and a fixing bolt to be inserted in the collar, the collar being configured to be inserted through the upper through hole and the lower through hole aligned on the same axis.

Advantageous Effects of Invention

In the past, there has been no cylindrical bearing for bearing a load on a pivot shaft in the radial direction, and rotation about the pivot shaft was carried out while holding the pivot shaft or the collar with two flat bearings in the thrust direction.

Thus, there has been a defect in that unwanted friction occurs when a force in a direction other than a perpendicular direction is acting. In this regard, by bearing the force by adding a cylindrical needle bearing in an intermediate point in the lengthwise direction of the pivot shaft, smooth rotation of the rockable section by shifting of a user's body weight is enabled and adequate stability can be achieved.

BRIEF DESCRIPTION OF DRAWINGS

FIG. 4(*b*) is a perspective view of the truck from a front side.

FIG. 5(*b*) is a plan view illustrating an upper-side sliding surface of the rockable section.

DESCRIPTION OF EMBODIMENTS

Figure 1:
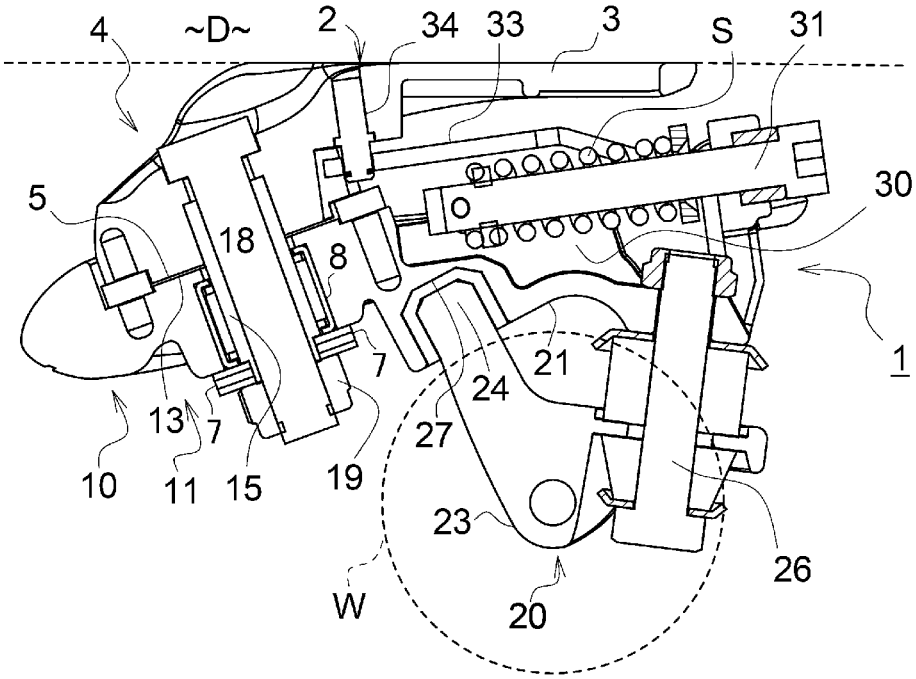
FIG. 1 is a cross-sectional view of a truck structure for a skateboard in Example 1.
Figure 2:
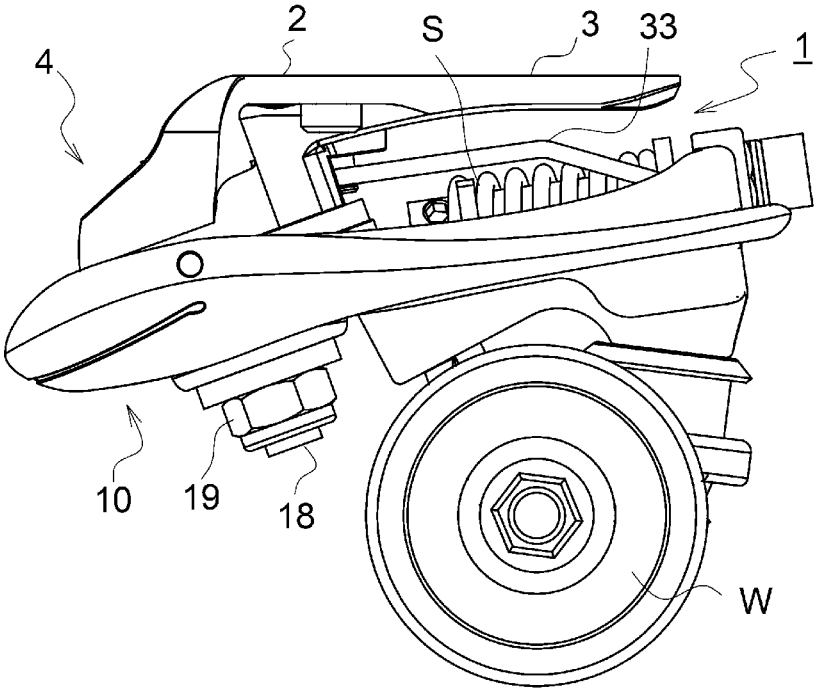
FIG. 2 is a side view of same.

This invention provides a truck structure in which a pivot shaft, which passes through in an up-down direction between a base fixed to a deck and a rockable section supporting the truck and fixes the rockable section in a rockable manner, is born by a cylindrical needle bearing which bears the pivot shaft in a radial direction, and the rockable section is displaced by shifting of a user's body weight whereas a steering angle is automatically returned to a neutral position through deflection of a coil spring so as to be repellent. With this structure, this invention achieves stability in rotation in a steering angle operation of the rockable section.

Example 1

Truck Structure

Example 1 of a truck structure for a skateboard of this invention will be described below with reference to the drawings.

The truck structure 1 of this example illustrated in FIGS. 1 to 7 is composed of: a support base 2 to be fixed to a deck D: and a rockable section 10 pivotally attached to the support base 2 and having a truck section 20.

In the case of the example in the drawings, the truck structure 1 of Example 1 is used for a rear wheel device for a skateboard, but in this invention, the truck structure 1 may be used on the front wheel side or on both the front and rear wheel sides.

Support Base

Figure 3:
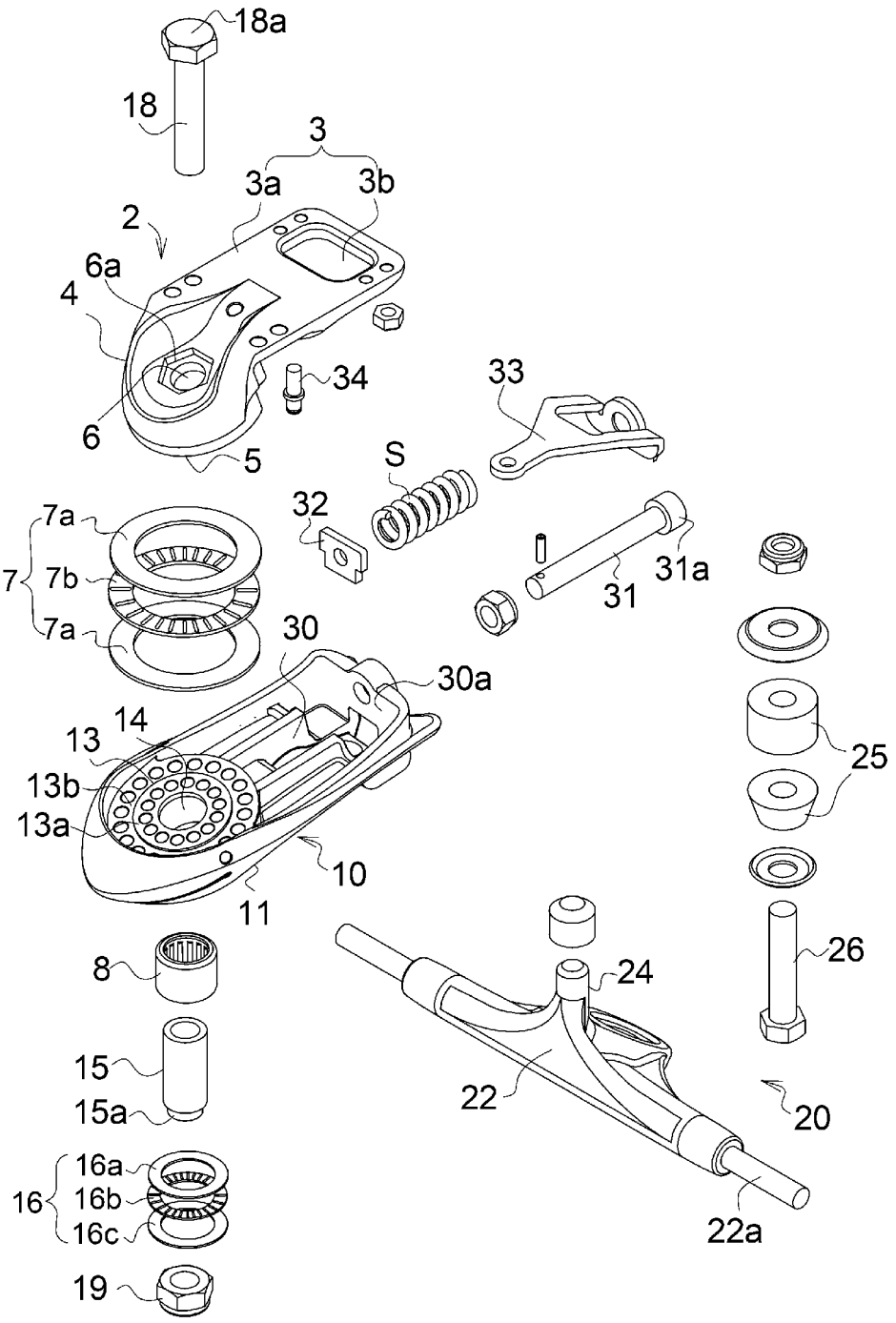
FIG. 3 is an exploded perspective view of same.
Figure 4A:
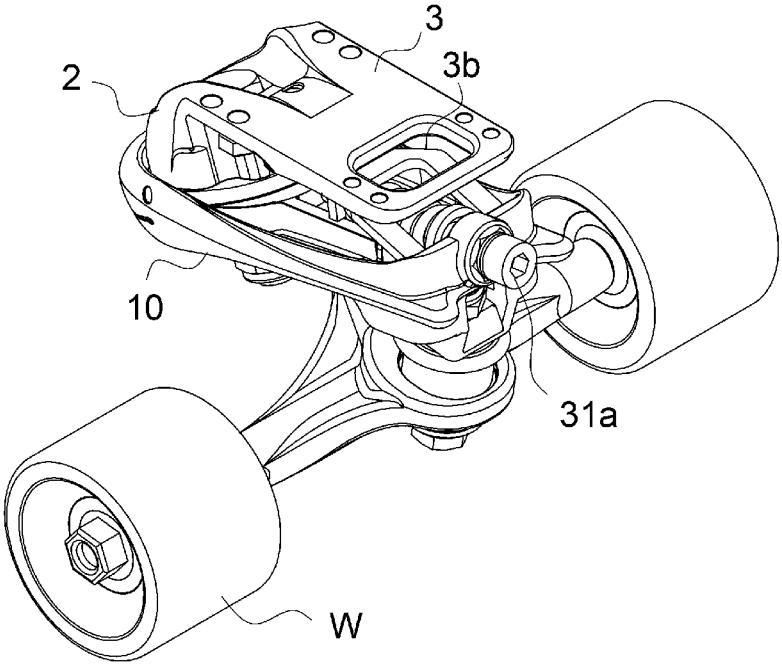
FIG. 4(*a*) is a perspective view of the truck from a rear side.
Figure 4B:
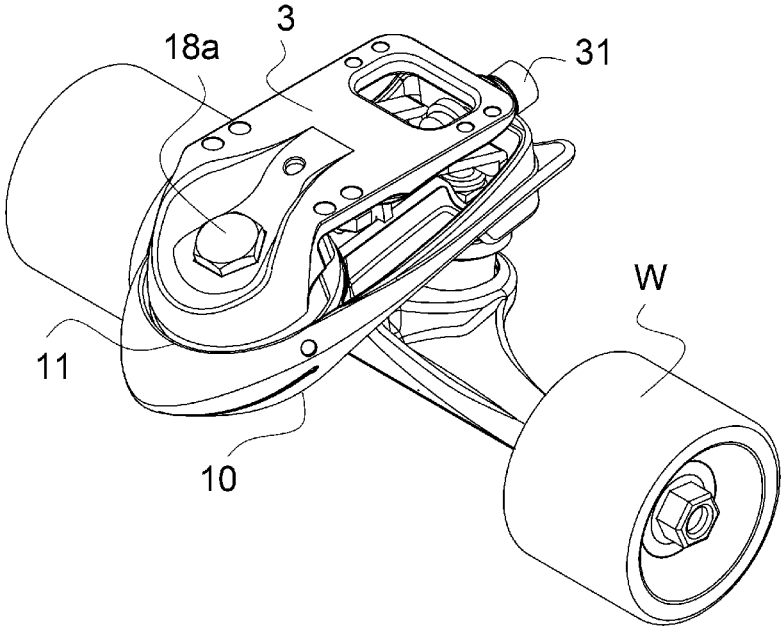
Figure 5A:
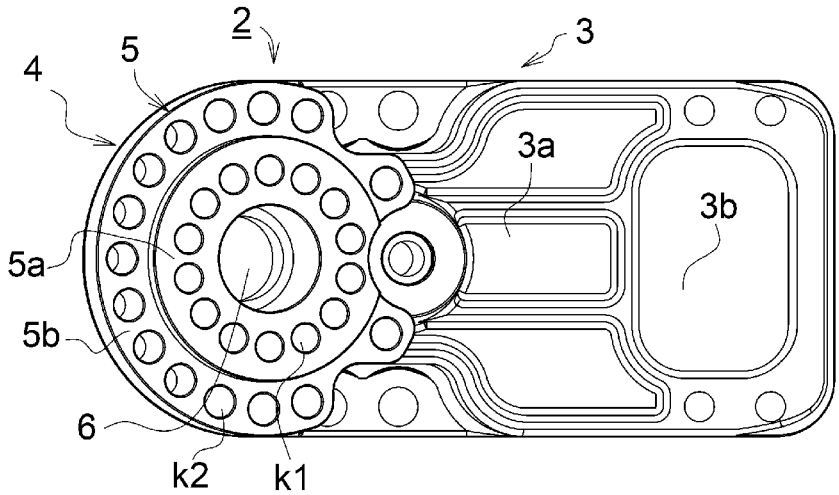
FIG. 5(*a*) is a bottom view illustrating a lower sliding surface of a base.
Figure 5B:
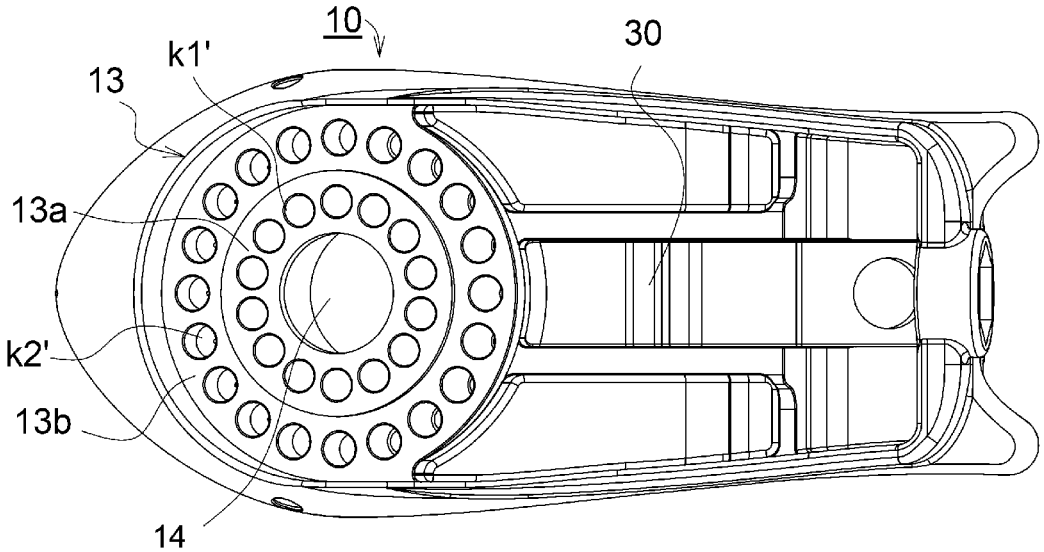

The support base 2 is composed of: a base section 3 including a large number of screw holes for fixing the support base to the deck D of the skateboard; and a bearing base section 4 juxtaposed with, and formed integrally with, the base section 3 (See FIGS. 1 and 3).

Base Section

The base section 3 has, formed therein: a bottom face section 3*a* for fixture, which is set so as to be substantially on the same plane as the deck D and is screwed and secured to the deck D by means of the screw holes; and a window hole 3*b* that is drilled at the center of the bottom face section 3*a*.

Bearing Base Section

The bearing base section 4 is a section formed on the support base 2 side and serving to bear an upper portion of a fixing bolt 18. The upper end of the bearing base section 4 is depressed by being inclined downward away from the deck D, and the lower end thereof has, formed therein, a substantially circular upper-side sliding contact surface 5 which comes into contact with a lower-side sliding contact surface 13 of the rockable section 10.

An upper through hole 6 for the fixing bolt 18 is drilled in a substantially central portion of the bearing base section 4. A receiving section 6*a*, which is for engagement with a bolt head section and which is depressed in a hexagonal shape (as viewed in a plan view), is formed on the upper side of the bearing base section 4 above the upper through hole 6.

Sliding Surface

Figure 6:
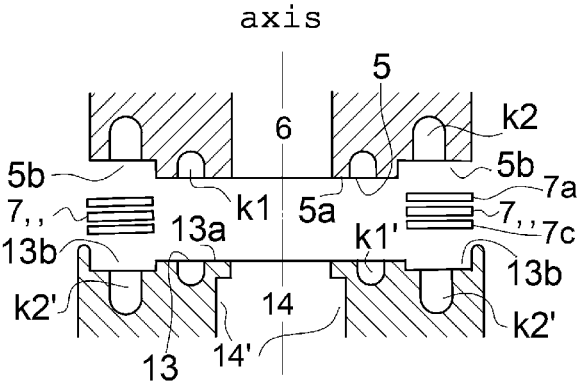
FIG. 6 is a partial cross-sectional view illustrating a position of a first thrust bearing on sliding contact surfaces of the base and the rockable section.

The upper-side sliding contact surface 5 and the lower-side sliding contact surface 13 are formed in the following manner as schematically illustrated in FIG. 6. The upper-side sliding contact surface 5 has, formed therein: an inner ring raised section 5*a* that is provided about the axis of the upper through hole 6 and formed from a flat surface having a small diameter and oriented downward; and an outer ring lowered section 5*b* that is concentric with the inner ring raised section 5*a* and is formed from a flat surface having a large diameter. The lower-side sliding contact surface 13 has, formed therein: an inner ring raised section 13*a* that is provided about the axis of a lower through hole 14 and formed from a flat surface having a small diameter and oriented upward, and an outer ring lowered section 13*b* that is concentric with the inner ring raised section 13*a* and is formed from a flat surface having a large diameter.

When the upper-side sliding contact surface 5 and the lower-side sliding contact surface 13 are made to overlap each other such that the upper through hole 6 and the lower through hole 14 coincide with each other, distal end surfaces of the inner ring raised section 5*a* and the inner ring raised section 13*a* coincide with each other and the outer ring lowered section 5*b* and the outer ring lowered section 13*b* coincide with each other.

A large number (14 in the example in the drawings) of holes k1 which are open on the upper-side sliding contact surface 5 side are formed in the inner ring raised section 5*a* such that the holes k1 are aligned annularly at equal intervals about the aforementioned axis. A large numbers of holes k1' are similarly formed in the inner ring raised section 13*a* on the lower-side sliding contact surface 13 side such that the holes k1' are aligned annularly at equal pitches about the axis.

Accordingly, even when the upper and lower inner ring raised sections 5*a* and 13*a* are in abutment, since the contact area is reduced, smooth rotation is possible.

Similarly, a large number (20 in the example in the drawings) of holes k2' which are open on the lower-side sliding contact surface 13 side are formed in the protruding manner in the outer ring lowered section 13*b* such that the holes k2' are aligned annularly at equal intervals about the aforementioned axis. A large numbers of holes k2 are similarly provided in a depressed manner in the outer ring lowered section 5*b* on the upper-side sliding contact surface 5 side such that the holes k2 are aligned annularly at equal pitches about the axis. (See FIGS. 5 and 6.)

First Thrust Bearing

The outer ring lowered section 5*b* of the upper-side sliding contact surface 5 and the outer ring lowered section 13*b* of the lower-side sliding contact surface 13 fit together via a first thrust bearing, and the inner ring raised section 5*a* of the upper-side sliding contact surface 5 and the inner ring raised section 13*a* of the lower-side sliding contact surface 13 coincide with each other.

The first thrust bearing 7 is inserted into, so as to fill up, the space formed between the outer ring lowered section 5*b* and the outer ring lowered section 13*b*.

The first thrust bearing 7 is composed of: a washer 7*a* on the upper side; a thrust needle bearing 7*b* in the middle; and a washer 7*c* on the lower side.

Due to the first thrust bearing 7 being interposed between the upper and lower outer ring lowered sections 5*b* and 13*b*, friction between the sliding contact surfaces 5 and 13 during sliding can be reduced.

In addition, since the contact area between the washers and the upper and lower outer ring lowered sections 5*a* and 13*a* is also reduced, smooth rotation is possible (see FIG. 6).

Rockable Section

The rockable section 10 is composed of: a rotation base section 11 pivotally attached in correspondence with the bearing base section 4; and a truck section 20 that is juxtaposed with, and formed integrally with, the rotation base section 11 on the rear side of the rotation base section 11 and supports an axle of a wheel W.

Lower Through Hole

As stated above, the upper through hole 6 and the lower through hole 14 formed in the rotation base section 11 of the rockable section 10 are aligned on the same axis and function as a single through hole by being aligned in an up-down direction.

The upper portion of the lower through hole 14 has the same diameter as the upper through hole 6, but the portion thereof extending continuously from a slightly lower portion down to the lower end thereof is formed into an enlarged diameter hole section 14' having a large diameter that is larger than the diameter of the upper through hole 6.

Needle Bearing

The size of the enlarged diameter hole section 14' is such that a needle bearing 8 of a cylindrical type (radial type) is accommodated therein on the outer side of a collar 15 without a gap.

The needle bearing 8 may be any type of needle bearing that is capable of bearing the pivot shaft in the radial direction; the one used in the example illustrated in the drawing is a needle roller bearing equipped with a retainer.

The collar 15 is inserted through the continuous upper through hole 6 and lower through hole 14 in this way, and the fixing bolt 18 serving as the pivot shaft is inserted in the collar 15.

The needle bearing 8 for bearing the collar 15 in the radial direction is inserted into the enlarged diameter hole section 14' of the lower through hole 14 before insertion of the collar 15.

The lower end of the bolt 18 protruding downward from the lower through hole 14 is secured by a nut 19 via a second thrust bearing 16.

Second Thrust Bearing

The second thrust bearing 16, which has a doughnut-like shape with a small diameter, is interposed between the lower end of the cylindrical needle bearing 8 and the nut 19 at the end of the lower through hole 14 of the rockable section 10 so that a hole section of the thrust bearing hooks onto a lower end step section 15*a* of the collar 15 for the purpose of reducing friction at the time of sliding.

The second thrust bearing 16 is composed of: a washer 16*a* on the upper side; a thrust needle bearing 16*b* in the middle; and a washer 16*c* on the lower side.

Figure 7:
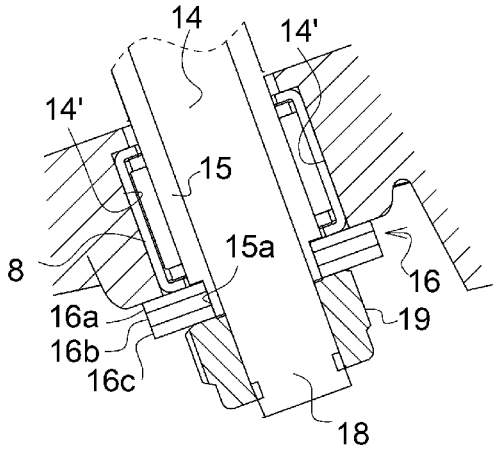
FIG. 7 is a partial enlarged view indicating positions of a needle bearing and a second thrust bearing.

In the second thrust bearing 16, the washer 16*a* on the upper side contacts the lower end of the needle bearing 8 and the washer 16*c* on the lower side contacts, via the thrust needle bearing 16*b*, the upper side of the nut 19 that is secured onto the lower end of the fixing bolt 18 (see FIG. 7).

Truck Mounting Section

The rotation base section 11 extends in the lengthwise direction so as to define a truck mounting section 21 for the truck section 20.

The truck mounting section 21 includes: a pivot hole 27 that is open on the lower side; and a hole section 28 for insertion of a king pin 26, which penetrates in the up-down direction.

Truck Section

The truck section 20 is provided with a yoke 22 which extends horizontally in a direction orthogonal to a traveling direction and to which wheel mounting shafts 22*a* are fixed at both right and left ends, and the wheel W is rotatably attached to each of the wheel mounting shafts with a nut and the like.

The yoke 22 is provided with a tongue-piece-shaped hanger 23 projecting in the lateral direction from a side face of the yoke main body at the center thereof. The hanger 23 is sandwiched by two, upper and lower bushing rubbers 25 formed from an elastic body such as urethane rubber from both upper and lower sides, then the king pin 26 is inserted through a bolt hole opened at the center position of these members, and the yoke 22 is secured by a nut and a washer at the lower end thereof.

The yoke 22 is elastically supported by the king pin 26 while being sandwiched by the bushing rubbers 25 on both the upper and lower sides thereof.

A pivot 24 crossing the king pin 26 at a predetermined angle is formed on the yoke 22, and the pivot 24 is formed into a known configuration in which a distal end of the pivot 24 is inserted in the pivot hole 27 via a rubber bushing and the like so as to be supported in a rotatable manner.

In the interior of the rockable section 10 on the rear side, an accommodation section 30 formed from a rear wall and left and right side walls extending to the left and right is provided, and a coil spring S is inserted in the accommodation section.

An adjusting bolt 31, the distal end of which has a screw threaded thereon, is screwed through a center of a rear wall 30*a* of the accommodation section 30 so as to extend through the center of the accommodation section 30 in the lengthwise direction, and a knurled head section 31*a* projects to the outside from the rear wall 30*a*.

The adjusting bolt 31 extends in the accommodation section 30 so as to pass through a hollow section in the center of the coil spring S. A plate-like nut 32 formed into a square shape so as not to rotate in the accommodation section 30 is screwed onto the distal end of the adjusting bolt 31.

Accordingly, due to the head section 31*a* of the adjusting bolt 31 being turned, the plate-like nut 32 can undergo screw movement in forward and rearward directions along the axial direction of the adjusting bolt 31.

The plate-like nut 32 abuts against the distal end of the coil spring S, and together with a link piece 33 (described later), extendably compresses the coil spring S.

The link piece 33 is passed between the base 2 and the rockable section 10.

The link piece 33 is formed from a plate piece having a substantially L-shaped cross section. In the link piece 33, the distal end of a long piece 33*a* is pivotally attached to a projecting shaft 34 fixed onto an upper face on the bearing base section 4 side, and a hole is drilled in a bent short piece 33*b*. The link piece 33 covers the coil spring S in the accommodation section 30. The adjusting bolt 31 passes through the link piece 33 in a position where the link piece 33 contacts the rear end of the coil spring S, and the rear end of the link piece 33 is pivotally attached to the adjusting bolt 31.

Accordingly, when the head section 31*b* of the adjusting bolt 31 is turned in the tightening direction, the coil spring S sandwiched between the plate-like nut 32 and an end section 33*b* of the link piece 33 is gradually compressed according to a forward movement of the plate-like nut 32 toward the link piece 33, whereas when the head section 316 is turned in the opposite direction, compression of the spring is gradually reduced according to a rearward movement of the plate-like nut 32; in this way, elastic force can be finely adjusted.

Example 2

Figure 8:
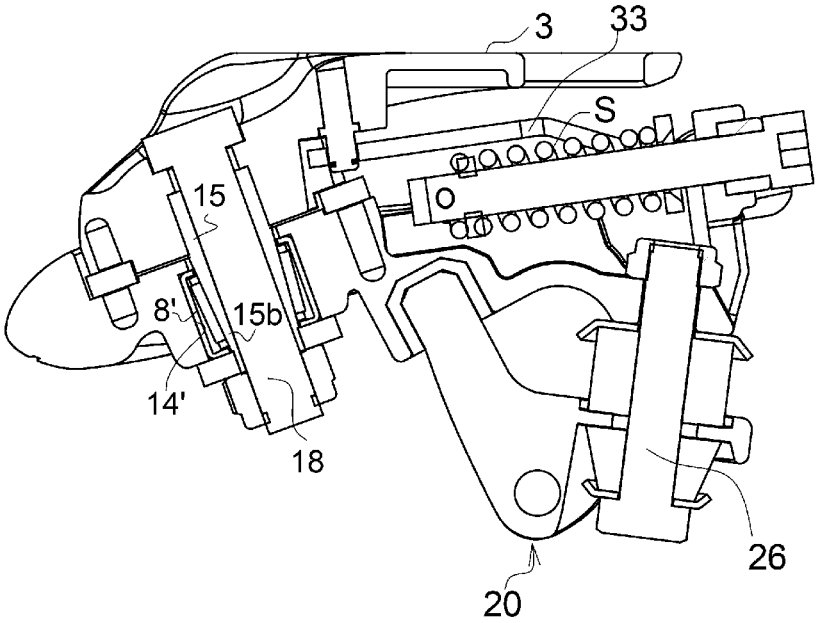
FIG. 8 illustrates a truck structure for a skateboard in Example 2.

In Example 1 above, a case in which the needle bearing 8 has a cylindrical shape with uniform dimensions in the transverse plane is presented as an example: this invention, however, may also adopt a needle bearing 8' having a bearing surface with a tapered surface shape, as illustrated in FIG. 8.

In the example illustrated in the drawing, substantially in the lower half of the collar 15, the side that is accommodated in the lower through hole 14 is formed into a tapered surface 15*b* in which the diameter of the collar is gradually reduced downward.

The needle bearing 8 is formed as a conical bearing by being arranged obliquely in a tapered posture with a downwardly narrowing width so as to conform to the tapered surface 15*b* of the collar 15.

Accordingly, irregular waving in the rotation of the rockable section 10 is prevented, and even smoother bearing operation is possible.

The other configurations are equivalent to the structure in Example 1 above and will therefore not be described again.

This invention is not limited to the above examples and can be changed in design in a variety of ways as far as the essence of the invention remains intact.

REFERENCE SIGNS LIST

1 Truck Structure
2 Support Base
3 Base Section
4 Bearing Base Section
5 Upper-Side Sliding Contact Surface
5*a* Inner Ring Raised Section
5*b* Outer Ring Lowered Section
6 Upper Through Hole
7 First Thrust Bearing
8 Needle Bearing
10 Rockable Section
11 Rotation Base Section
13 Lower-Side Sliding Contact Surface
13*a* Inner Ring Raised Section
13*b* Outer Ring Lowered Section
14 Lower Through Hole
14' Enlarged Diameter Hole Section
15 Collar
15*a* Small Diameter Step Section
16 Second Thrust Bearing
18 Fixing Bolt
19 Nut
20 Truck Section
D Deck
S Coil Spring
W Wheel

The invention claimed is:

1. A truck structure for a skateboard comprising:

a support base to be fixed to a deck;

a rockable section to be pivotally attached to the support base through a pivot shaft, the rockable section including a truck section, the truck structure being configured to support the rockable section such that the rockable section is turnable in a left-right direction from a neutral position of the truck section; and a coil spring configured to bias the rockable section such that the rockable section is returnable to the neutral position, wherein an upper through hole is formed in the support base, a lower end of the upper through hole being opened in an upper-side sliding contact surface of the support base, the upper through hole being configured to receive insertion of an upper portion of the pivot shaft, a lower through hole is formed in the rockable section, the lower through hole and the upper through hole being provided on the same axis, an upper end of the lower through hole being opened in contact with the upper-side sliding contact surface, the lower through hole being configured to receive insertion of a lower portion of the pivot shaft, an enlarged diameter hole section is provided in the lower through hole, the enlarged diameter hole section being configured to accommodate a needle bearing having a cylindrical shape, the needle bearing being fit to an outer side of at least a lower shaft portion of the pivot shaft, the needle bearing has the cylindrical shape bears the lower shaft portion of the pivot shaft, the pivot shaft includes a collar and a fixing bolt to be inserted in the collar, the collar being configured to be inserted through the upper through hole and the lower through hole aligned on the same axis, the lower portion of the collar is formed in a tapered shape in which the diameter of the collar gradually decreases toward a lower side, and the needle bearing having the cylindrical shape and accommodated in the enlarged diameter hole section of the lower through hole is formed in a tapered shape that fits onto an outer side of at least the lower shaft portion of the pivot shaft.

2. The truck structure for a skateboard of claim 1, wherein an inner ring raised section having a small diameter and an outer ring lowered section having a large diameter and being concentric with the inner ring raised section are formed in the upper-side sliding contact surface of the support base around the upper through hole, an inner ring raised section having a small diameter and an outer ring lowered section having a large diameter and being concentric with the inner ring raised section are formed in a lower-side sliding contact surface of the rockable section around the lower through hole, bottomed circular holes aligned annularly at equal intervals about the axis of the upper and lower through holes are formed on each of the inner ring raised sections and the outer ring lowered sections of the support base and the rockable section, and a first thrust bearing formed from a thrust bearing and washers sandwiching the thrust bearing from above and below is provided in a space between the outer ring lowered section of the support base and the outer ring lowered section of the rockable section, the space being formed when the inner ring raised section of the support base and the inner ring raised section of the rockable section are brought into firm contact with each other without a gap.

3. The truck structure for a skateboard of claim 2, wherein a second thrust bearing formed from a thrust bearing and washers sandwiching the thrust bearing from above and below is provided between a lower end of a needle bearing and a nut screwed onto a lower end of a fixing bolt.

4. The truck structure for a skateboard of claim 3, wherein a small diameter step section onto which the second thrust bearing is hooked is formed in a lower portion of the collar.

5. The truck structure for a skateboard of claim 1, wherein a second thrust bearing formed from a thrust bearing and washers sandwiching the thrust bearing from above and below is provided between a lower end of a needle bearing and a nut screwed onto a lower end of a fixing bolt.

6. The truck structure for a skateboard of claim 5, wherein a small diameter step section onto which the second thrust bearing is hooked is formed in a lower portion of the collar.

* * * * *